US005372519A

United States Patent [19]

Chen

[11] Patent Number: 5,372,519

[45] Date of Patent: Dec. 13, 1994

[54] ELECTRICAL CONNECTOR

[76] Inventor: Michael Chen, No. 11, Alley 16, Lane 337, Sec. 1, Ta-Tung Rd., Hsi-Chih Town, Taipei Hsien, Taiwan, Prov. of China

[21] Appl. No.: 154,475

[22] Filed: Nov. 19, 1993

[51] Int. Cl.[5] ..... H01R 4/24

[52] U.S. Cl. ..... 439/395; 439/733

[58] Field of Search ..... 439/733, 752, 595, 599, 439/600, 751, 741, 873, 638, 651, 654, 655

[56] References Cited

U.S. PATENT DOCUMENTS

| | | | |
|---|---|---|---|
| 2,117,298 | 5/1938 | Chirelstein | 439/752 |
| 3,501,736 | 3/1970 | Norris | 439/752 |
| 4,084,877 | 4/1978 | Knickerbocker | 439/752 |
| 4,652,070 | 3/1987 | Suffi | 439/404 |
| 4,946,399 | 8/1990 | Kawashima | 439/752 |

*Primary Examiner*—David L. Pirlot
*Attorney, Agent, or Firm*—Bacon & Thomas

[57] ABSTRACT

An electrical contact includes a shell, a row of contacts mounted within respective slots on the shell, and a fastening device having pins inserted into respective pin holes on the shell and the contacts to hold down the contact in position, wherein the shell has a projecting block inside each contact mounting slot, a row of retaining holes, and pairs of opposite retaining blocks respectively disposed in either retaining hole; the contacts are integrally made and linked in parallel by connecting portions therebetween, each contact having a top stop edge disposed at an elevation below the respective pointed tip and stopped below the projecting block in either contact mounting slot; the contact fastening device has pairs of opposite hooks respectively hooked on the retaining blocks in either retaining hole on the shell.

3 Claims, 6 Drawing Sheets

ELECTRICAL CONNECTOR

BACKGROUND OF THE INVENTION

The present invention relates to electrical connectors in adapted for use in communication systems, and relates more particularly to the structure and positioning of the contacts for such electrical connectors.

The contacts of the electrical connectors which are commonly used in communication systems have pointed ends, that make a respective electric contact when they pierce through the insulator of a respective electrical wire. These electrical connectors are, as shown in FIG. 1, are commonly comprised of a shell, a plurality of contacts inserted in respective contact mounting holes on the shell, and a contact fastening device fastened to the shell to hold down the contacts. Because the contacts are respectively inserted into the contact mounting slots piece by piece, much labor is needed during the assembly process. When the contacts are respectively inserted into the contact mounting slots, they may displace easily, causing the fastening of the contact fastening device difficult. When the contact fastening device is connected to the shell, it must be sealed through a ultrasonic sealing process. This special processing process complicates the assembly procedure and greatly increases the manufacturing cost of the electrical connectors.

U.S. Pat. No. 4,964,812, issued to John A. Siemon, discloses a wire connecting system in which plastic pins are into respective holes on the shell and then melted to fill up the holes, and therefore the contact pins are positioned. As this method needs to employ a special melting process, it does not eliminate the aforesaid drawbacks.

U.S. Pat. No. 3,798,587, issued to Benjamin Clement Ellit, et. al., discloses devices for making electrical connections, in which the shell is comprised of two symmetrical halves that are connected together and then sealed through a welding process after the insertion of the contacts. As the contacts are individually made and then fastened to a respective contact mounting slot piece by piece, this structure of electrical contact still cannot eliminate the aforesaid drawbacks.

SUMMARY OF THE INVENTION

The present invention has been accomplished under the aforesaid circumstances. It is therefore the principal object of the present invention to provide an electrical contact which eliminates the aforesaid drawbacks. According to the preferred embodiment of the present invention, the electrical connector comprises a shell, a row of contacts mounted within respective slots on the shell, and a fastening device having pins inserted into respective pin holes on the shell and the contacts to hold down the contact in position, wherein the shell has a projecting block inside each contact mounting slot, a row of retaining holes, and pairs of opposite retaining blocks respectively disposed in either retaining hole; the contacts are integrally made and linked in parallel by connecting portions therebetween, each contact having a top stop edge disposed at an elevation below the respective pointed tip and stopped below the projecting block in either contact mounting slot; the contact fastening device has pairs of opposite hooks respectively hooked on the retaining blocks in either retaining hole on the shell. As the contacts are integrally made in a unitary piece, they can be quickly fastened to the shell.

The projecting block in each contact mounting slot stops the respective contact in position as the contacts are inserted into respective contact mounting slots on the shell. When the contact fastening device is fastened to the shell, the contacts are held down. By means of hooking the hooks of the contact fastening device on the respective retaining blocks of the shell, the contact fastening device does not disconnect from the shell when the contact fastening device and the shell are connected together, and therefore no any sealing process is needed to seal the connection.

DETAILED DESCRIPTION OF THE PREFERRED EMBODIMENT

Figure 1:
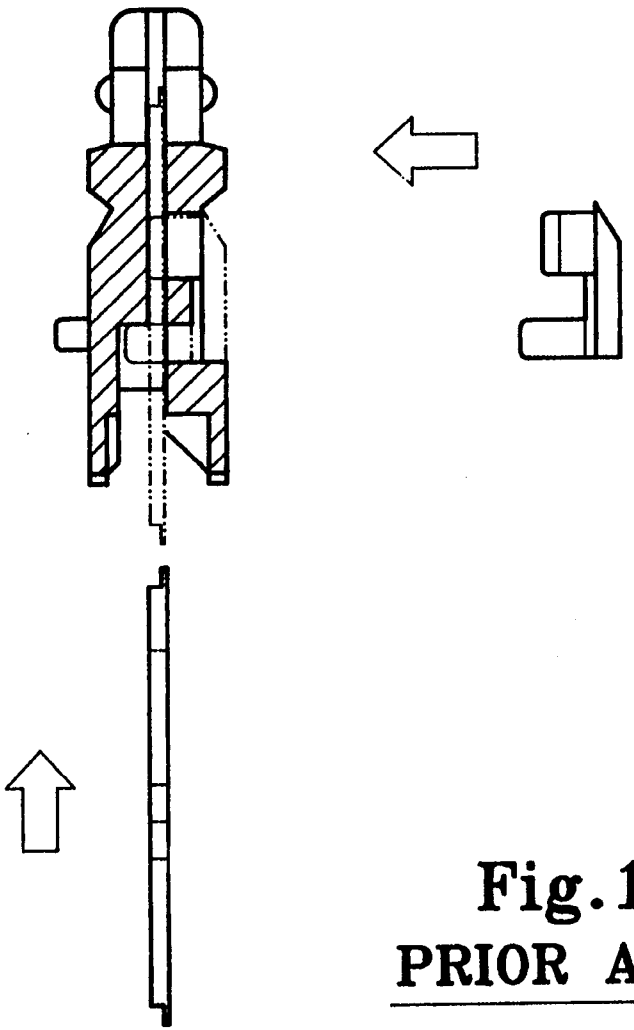
Fig. 1 PRIOR ART
FIG. 1 is a sectional view of an electrical connector according to the prior art.
Figure 2:
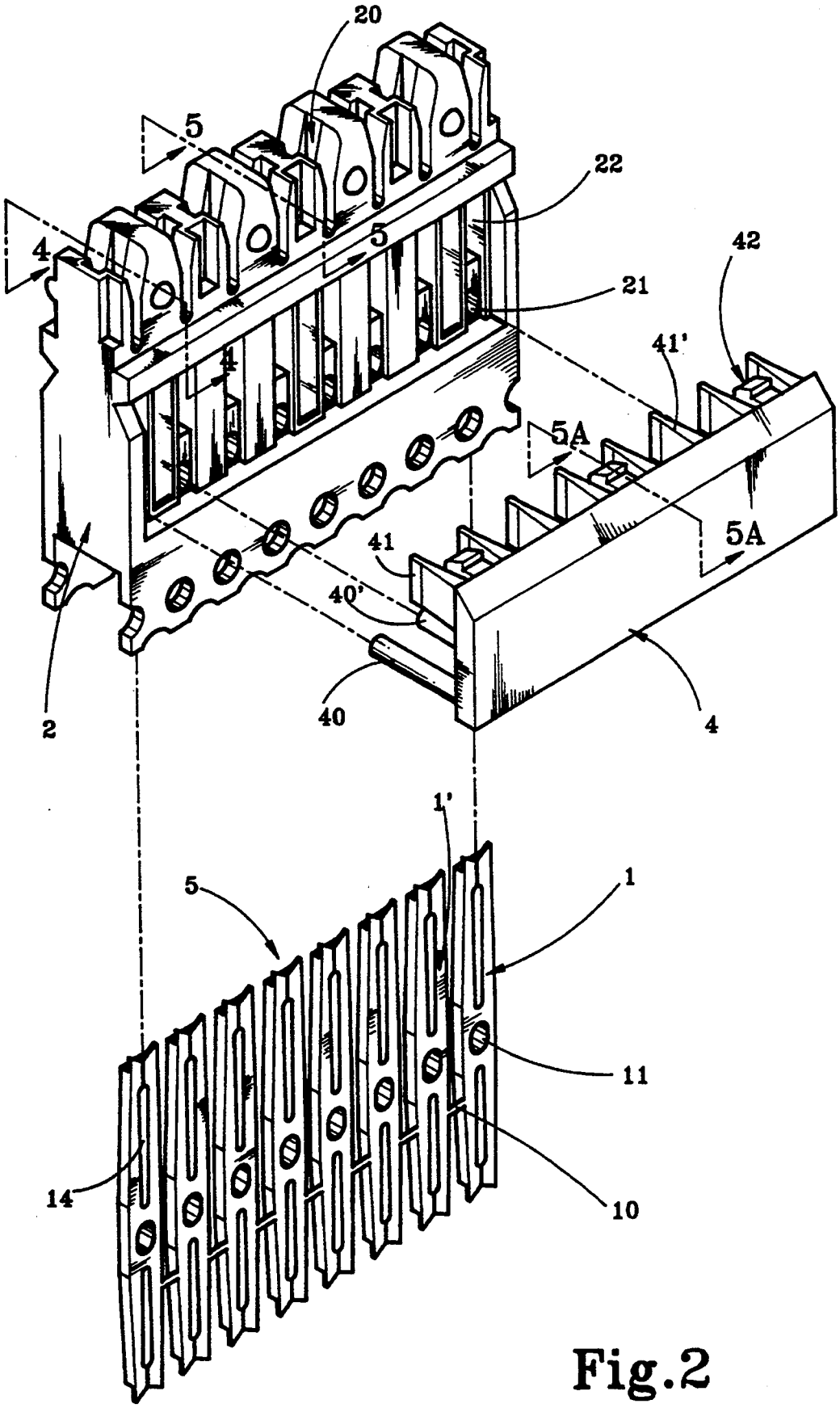
FIG. 2 is an exploded view of an electrical connector according to the present invention.
Figure 7:
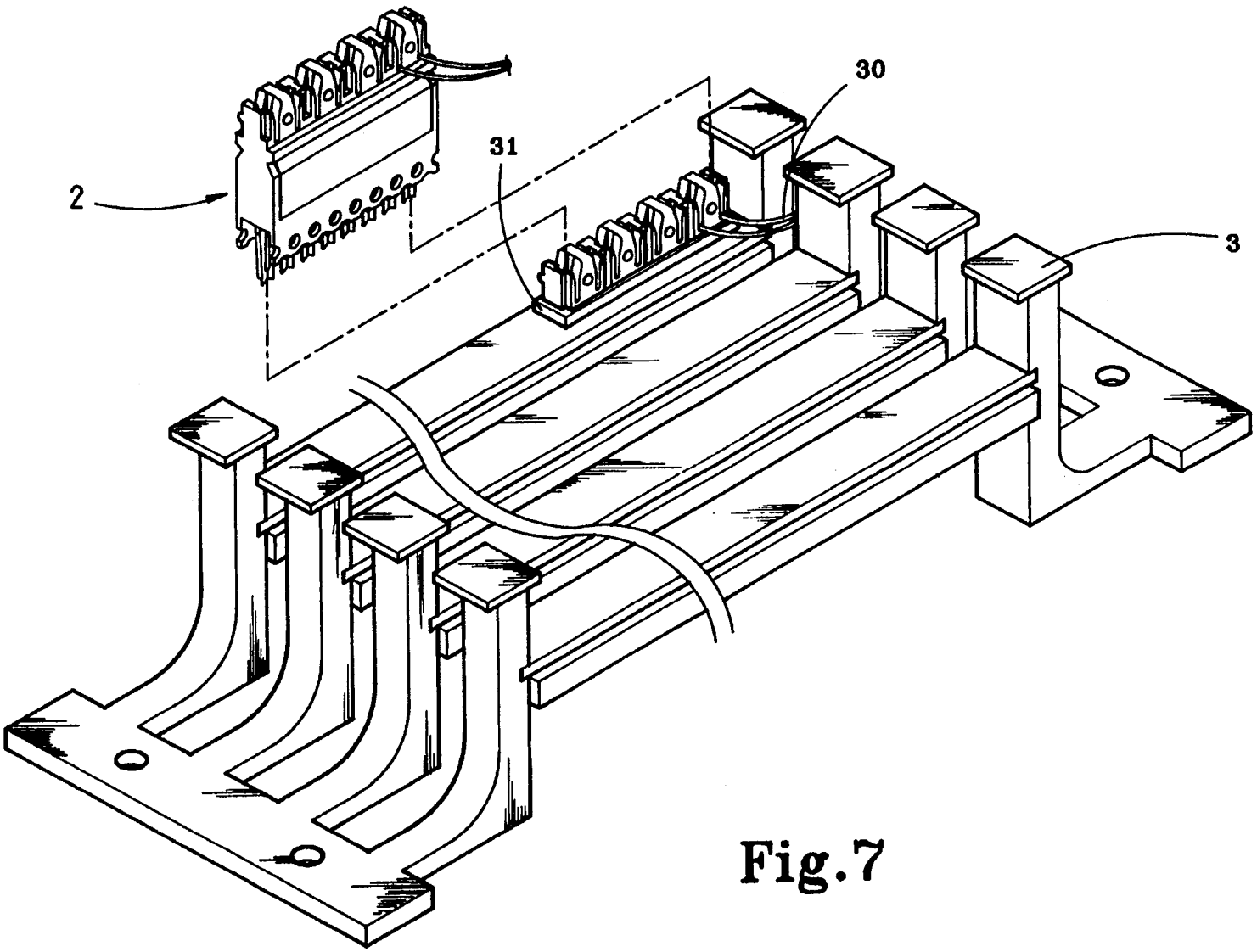
FIG. 7 is an installed view showing the electrical connector of FIG. 2 installed in a distributing frame.

Referring to FIGS. 2 and 7, an electrical connector in accordance with the present invention is designed for fastening to a matching connector 31 on a distributing frame 3 of a communication system to connect communication wires 30, generally comprised of a shell 2, a contact frame 5, and a contact fastening device 4. The contact frame 5 consists of a row of parallel contacts 1;1' linked by connecting portions 10, each contact 1 (1') having a respective pin hole 11 in the middle. The connecting portions 10 are disposed at the same elevation below the pin holes 11 on the contacts 1;1'. Because the connecting portions 10 are disposed at a lower elevation than the pin holes 11, they will not jammed in the matching connector 31 on the distributing frame 3. The shell 2 comprises a plurality of vertical contact mounting slots 20, which receive the contacts 1;1' of the contact frame 5. The connecting portions 10 are made according to the pitch between the vertical contact mounting slots 20 so that the contacts 1;1' can be precisely fitted into the vertical contact mounting slots 20. The shell 2 further comprises a horizontal rows of pin holes 21 and a horizontal row of through holes 22 respectively linked to the contact mounting slots 20 at different elevations, and a row of retaining holes 23 spaced between the row of through holes 22. Each retaining hole 23 comprises two opposite retaining blocks 230;231.

Figure 3:
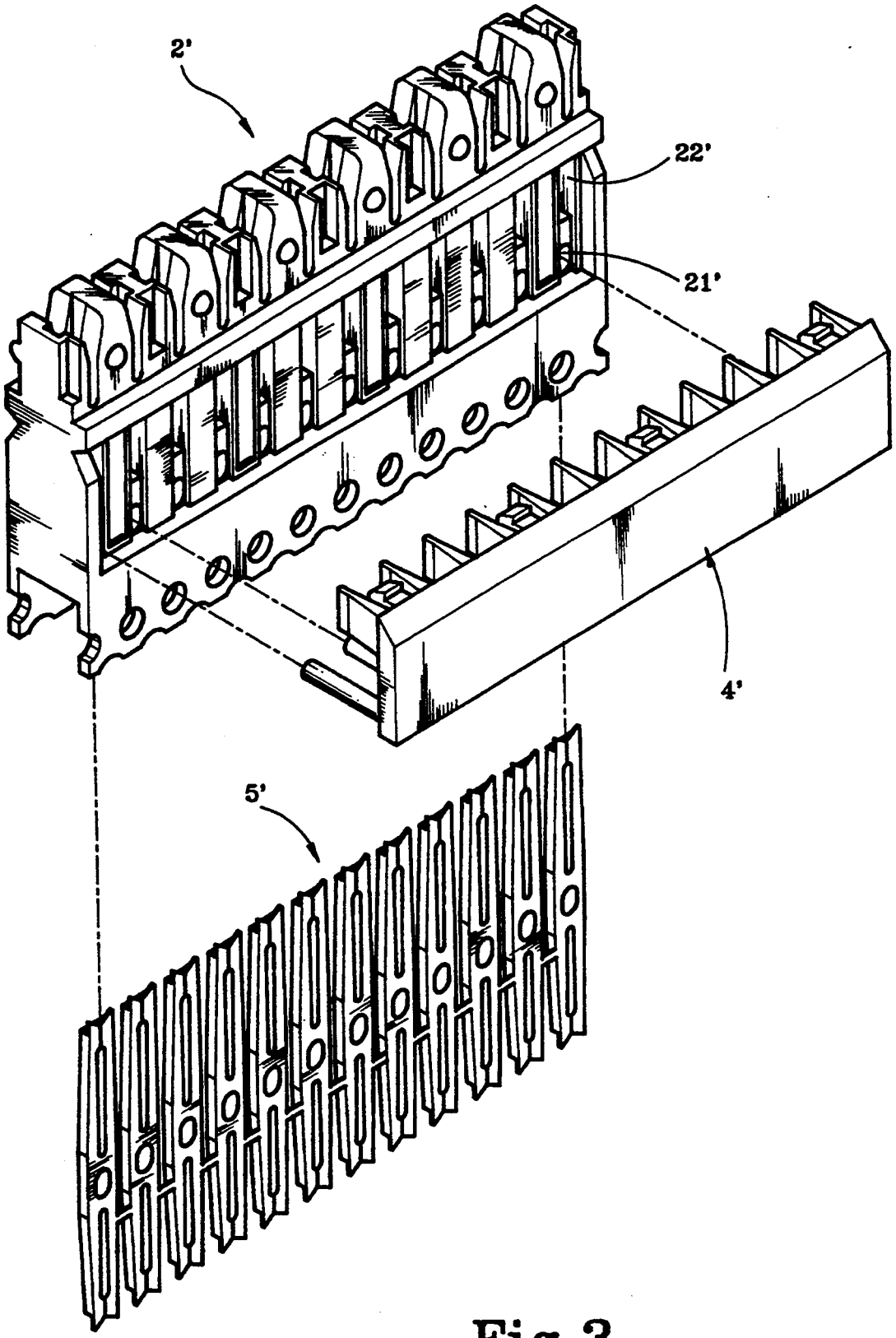
FIG. 3 is an exploded view of an alternate form of the electrical connector of the present invention.

The design of the contact frame 5 permits the row of contacts 1;1' to be conveniently fastened to the vertical contact mounting slots 20 of the shell 2 at the same time. Therefore, the assembly process of the electrical connector is simple. The number of contacts of the contact frame 5 is determined according to the type of the shell 2. The shell 2 shown in FIG. 2 is for holding a contact frame 5 consisted of eight pieces of linked contacts. The shell 2' shown in FIG. 3 is for holding a contact frame 5' consisted of twelve pieces of linked contacts. Of course, the contact fastening device 4 (or 4' as shown in FIG. 3) must be made to match with the shell 2 or 2'.

Figure 5A:
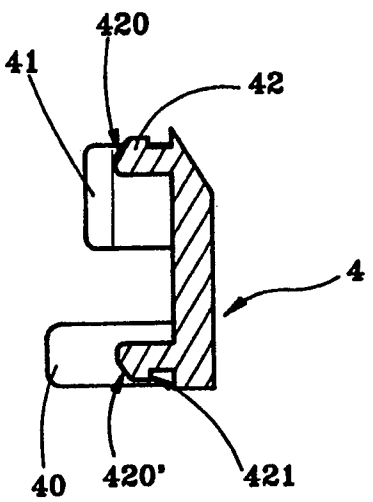
FIG. 5A is a cross section taken along line 5A—5A of FIG. 2.
Figure 5:
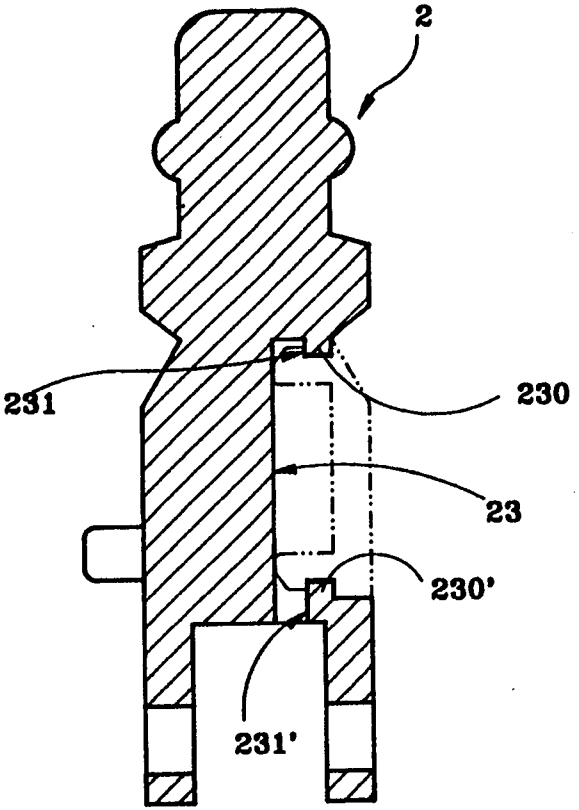
FIG. 5 is another cross sectional view of the electrical connector of FIG. 2, showing the positioning of the contact fastening device thereof.
Figure 4:
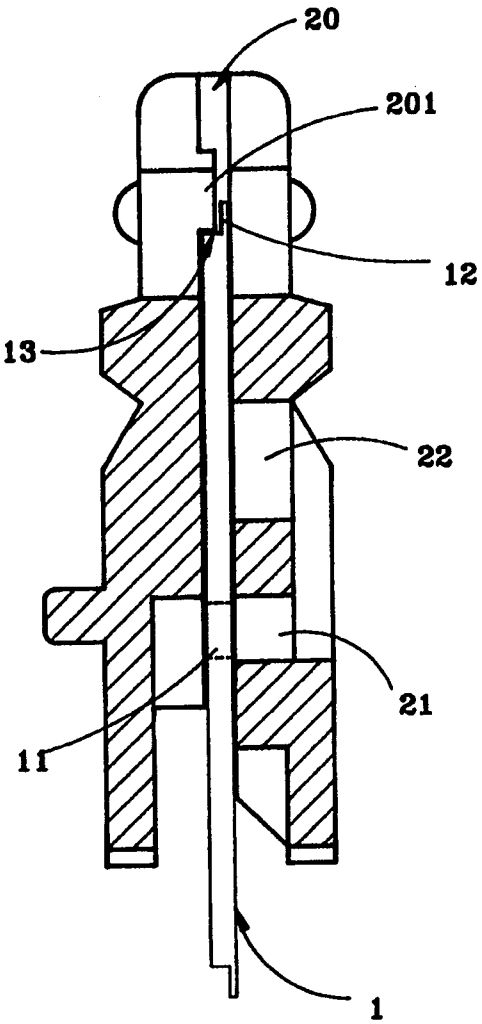
FIG. 4 is a cross sectional view of the electrical connector of FIG. 2, showing the structure of the vertical contact mounting slot.
Figure 6A:
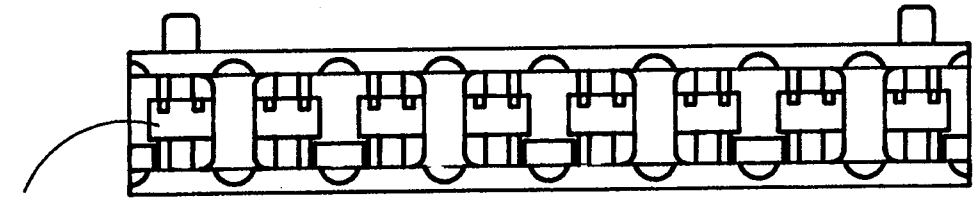
FIG. 6A is a top plan view of the electrical connector shown in FIG. 6.
Figure 6B:
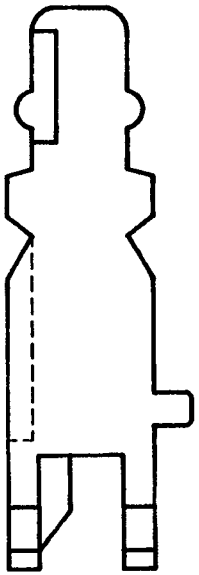
FIG. 6B is a right side elevational view of the electrical connector shown in FIG. 6.
Figure 6:
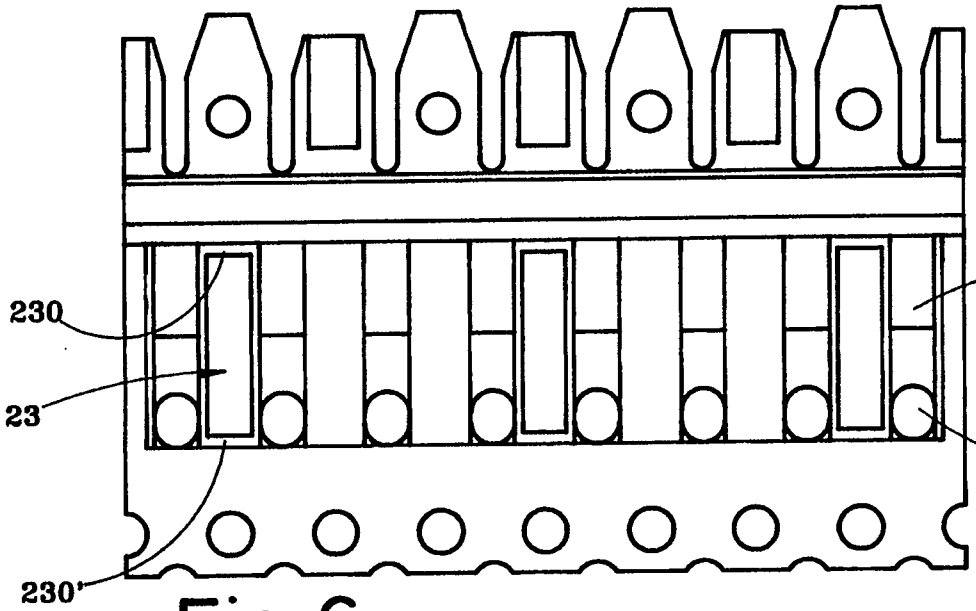
FIG. 6 shows a front elevational view of the electrical connector of FIG. 2.

Referring to FIGS. 4 and 5, the contacts 1;1' of the contact frame 1 are inserted into the contact mounting slots 20 of the shell 2 from the bottom. Each contact mounting slot 20 comprises a projecting block 201. Each contact 1(1') further comprises a pointed tip 12 longitudinally raising from a top stop edge 13 thereof and a longitudinal slot 14 spaced below the top stop edge. When the contact frame 5 is fastened to the shell 2, the top stop edges 13 of the contacts 1;1' are respectively stopped below the projecting block 201 on either contact mounting slot 20, and the pin holes 11 and longitudinal slots 14 on the contacts 1;1' are respectively aligned with the horizontal row of pin holes 21 and through holes 22 on the shell 2 while the pointed tip 12 passing over the respective projecting block 201. The contact fastening device 4 comprises a row of pins 40 horizontally disposed on one side at the bottom, a row of hooked tongues 41;41' horizontally disposed on the same side at the top and respective aligned with the pins 40, and pairs of vertically spaced hooks 42. The contact fastening device 4 is made from resilient plastics through an injection molding process. When the contact frame 5 is fastened to the shell 2, the contact fastening device 4 is then fastened to the shell 2 to hold down the contact frame 5 by: inserting the pins 40 through the pin holes 21 on the shell 2 into the pin holes 11 on the contacts 1;1' of the contact frame 5, and inserting the hooked tongues 41 through the through holes 22 on the shell 2 and then hooking the hooked tongues 41 in the longitudinal slots 14 on the contacts 1;1' of the contact frame 5, and inserting the hooks 42 of the contact fastening device 4 into the retaining holes 23 on the shell and then respectively hooking the hooks 42 on the retaining blocks 230;230'. Each hook 42 of the contact fastening device 4 has a front sloping edge 420 or 420', by which it can be smoothly guided into the hooked position with the mouth 421 thereof firmly engaged with the respective contact surface 231 or 231' on either retaining block 230 or 230'. The contact surface 231 of either retaining block 230 or 230' is disposed perpendicular to the inserting direction of the hooks 42, so that the hooks 42 can be firmly hooked on the retaining blocks 230;230' after the sloping edge 420 of each hook 42 passed over the respective retaining block 230 or 230'.

I claim:

1. An electrical connector of the type comprising a shell having a row of contact mounting slots, a row of contacts respectively mounted within said contact mounting slots and having a respective pointed tip for piercing into the insulator of an electrical wire, and a contact fastening device having a row of locating pins and a row of hooked tongues inserted through respective pin holes on said shell into respective pin holes on said contacts to hold down said contacts within said contact mounting slots, wherein said shell comprises a projecting block inside each contact mounting slot, a row of retaining holes, and pairs of opposite retaining blocks respectively disposed in said retaining holes, said contacts are integrally made and linked in parallel by connecting portions therebetween, each contact having a top stop edge disposed at an elevation below the respective pointed tip and stopped below the projecting block in one of the contact mounting slots, said contact fastening device comprises pairs of vertically spaced hooks respectively inserted into said retaining holes on said shell and hooked on a pair of retaining holes.

2. The electrical connector of claim 1 wherein the connecting portion between either two contacts is disposed at a lower elevation than the pin holes on said contacts.

3. The electrical connector of claim 1 wherein the pins holes on said contacts are respectively alinged with the pin holes on said shell as the top stop edges of said contacts are respectively stopped against the projecting block in either contact mounting slot.

* * * * *